US005351754A

United States Patent [19]

Hardin et al.

[11] Patent Number: 5,351,754

[45] Date of Patent: Oct. 4, 1994

[54] APPARATUS AND METHOD TO CAUSE FATIGUE FAILURE OF SUBTERRANEAN FORMATIONS

[75] Inventors: Nathanial A. Hardin, Forsyth, Ga.; George C. Morgan, Birmingham, Ala.

[73] Assignee: N. A. Hardin 1977 Trust, Forsyth, Ga. ; N. A. Hardin, trustee

[21] Appl. No.: 957,419

[22] Filed: Oct. 6, 1992

Related U.S. Application Data

[63] Continuation-in-part of Ser. No. 864,366, Apr. 6, 1992, abandoned, which is a continuation of Ser. No. 699,984, May 3, 1991, abandoned, which is a continuation-in-part of Ser. No. 563,053, Aug. 6, 1990, abandoned, which is a continuation-in-part of Ser. No. 370,050, Jun. 21, 1989, Pat. No. 4,945,986.

[51] Int. Cl.[5] ..... B06B 1/20; B06B 3/02; E21B 43/25

[52] U.S. Cl. ..... 166/249; 166/177; 166/250

[58] Field of Search ..... 166/249, 177, 113, 250, 166/248, 312, 308; 134/1; 417/53, 240, 437; 175/55, 56

[56] References Cited

U.S. PATENT DOCUMENTS 2,866,509 12/1958 Bodine, Jr. ..... 166/177
3,323,592 6/1967 Brandon ..... 166/249
3,765,804 10/1973 Brandon ..... 417/540
3,981,624 9/1976 Brandon ..... 417/53
4,022,275 5/1977 Brandon ..... 166/249

*Primary Examiner*—Stephen J. Novosad
*Attorney, Agent, or Firm*—Head & Johnson

[57] ABSTRACT

An improved sonic wave generating device and method transmits variable wave energy to a fluid medium that is transmitted to objects such as subsurface petroliforous formations to be treated. Reverberative pressures and wave energy are reduced by improvements to and from a positive pressure supplied feed pump which pumps the medium to the primary wave generating pump(s) includes means to maintain an increased hydrostatic or positive head to the suction inlet of the feed pump which prevents or neutralizes feed back energy waves from the wave generating device to the feed pump, along with a check valve located at the inlet to the primary pump(s) and a buffer system of conduits located between and in the outlet from the feed pump and the check valve to prevent and dampen recoiling energy waves produced by the pumps and augmenting cavitation valve system. Such apparatus and methods delivers kinetic energy resulting in stress against and into the interstices of the formation to produce virtual work strain and deformation, followed by periodic relief of the stress, thus releasing the potential energy of and within the formation to produce fatigue failure thereof.

59 Claims, 10 Drawing Sheets

APPARATUS AND METHOD TO CAUSE FATIGUE FAILURE OF SUBTERRANEAN FORMATIONS

RELATED APPLICATIONS

The present application is a continuation-in-part of U.S. application, Ser. No. 07/864,366 filed Apr. 6, 1992, now abandoned, which is a continuation of Ser. No. 07/699,984 filed May 3, 1991, now abandoned, which was a continuation-in-part of U.S. application Ser. No. 07/563,053, filed Aug. 6, 1990, now abandoned, which was a continuation-in-part Ser. No. 07/370,050, filed Jun. 21, 1989, now U.S. Pat. No. 4,945,986.

BACKGROUND OF THE INVENTION

Broadly, this invention is directed to the treatment of objects, particularly fluid containing subsurface strata or formations for the purpose of increasing the production of the fluids therefrom.

The concept of utilizing sonic waves and/or variable high frequency vibrations in the treatment of subsurface strata or formation is found in the prior art including but not limited to the early patents of Sherborne U.S. Pat. No. 2,670,101 and Bodine U.S. Pat. Nos. 2,355,618; 2,667,932; 2,871,943; 3,016,093; 3,016,095; and Reissue 23,381. These references have as a common denominator the creation and utilization of sonic standing waves, whether symmetrical or not which are repetitive or reoccurring without change, as a means of increasing oil recovery. As is typical of hydraulic fracturing of subterranean formations, the purpose was to apply substantially unidirectional application of fluid pressure and force against the formation until the formation yielded and fractured leaving vugular channels for the increased production and flow of the desired formation fluids.

The concept of methods and apparatus for creating sonic waves wherein the wave characteristics are variable or changeable at the will of the operator are found in many of the Clarence W. Brandon patents such as U.S. Pat. Nos. 3,981,624; 3,640,344; 3,045,749; 3,323,592; 2,866,509; 3,422,894; 3,302,720; 3,765,804; and 4,022,275. Brandon's concepts have been expanded and improved by the present invention.

For the purposes of this invention, Clarence W. Brandon, U.S. Pat. No. 3,981,624 issued Sep. 21, 1976 is incorporated herein by reference. In the aforesaid Brandon patent, the construction of the reciprocating pistons used in the sonic wave generator, i.e. the variable stroke pumping unit, sometimes referred to herein as "sonofrac machine" utilized a working plunger or piston which comprised a cylindrical member which was open at both ends yet divided by a partition. Reference is made to the description and specification relative to FIG. 33 of the aforesaid '624 patent. Immediately adjacent the partition and extending towards the forward end of the piston was a longitudinally extending slot which constituted the inlet port opening into the hollow interior of the piston. At the outer end of the piston was a valve chamber terminating in a conical valve seat with a spring loaded mushroom type valve normally closing the end of the piston. These pistons and their valves are internally operable to receive fluid under pressure capable of forcing fluid out against the spring loaded valve at a higher pressure and frequency. The variable stroke pump required that liquid medium, e.g. water and/or oil or other fluid, be delivered from a separate pump under sufficient pressure to enter the variable speed main pump piston along with and in conjunction with the movement of the piston.

A triplex type feed pump, i.e., a low speed/high pressure pump was provided as a means for delivering the fluid under pressure to the variable stroke sonofrac machine. It has been found to be important in treating subsurface formations that the energy generated by a sonofrac machine, such as found in the aforesaid Brandon patents, be directed away from the variable stroke pump generator into the formation with no part of that energy being lost or wasted, that is, that the energy not be allowed to reverberate back into the generating machine, or back to the feed pump.

The triplex feed pump was connected to an adjoining water tank with a supply or suction line for the source of liquid. Delivery of water from that tank into the piston of the triplex pump depended upon the very slight pressure exerted by the head or weight of water in the supply tank. In many instances this pressure was inadequate to overcome friction and resistance from the supply tank and suction inlet piping. Consequently, the cylinders of the triplex pump were not filled, and in some instances cavitation of the triplex pump occurred during operation. In other instances reflective or refractive energy waves from the sonofrac machine would disrupt the operation of the feed pump. As a result, the triplex pump was known to become damaged during tests and in any event was incapable of delivering sufficient water either in quantity or pressure to the variable stroke pump described in the aforesaid Brandon patent which has been incorporated by reference herein.

In addition, the Brandon sonofrac machine taught circulation of fluid from and between the two main piston pumps 100 and 101 and related cavitation valves to enhance pressures and wave formation, etc.. It has been found that this type of interconnected fluid circulation system created reverberations that tended to cancel system pressures, wave formation, etc.

Similarly, the connection of the two cavitation valves 82 to a single discharge line created similar cancellation and dampening of the enhanced pressures and enhanced wave energy which the valves were otherwise intended to produce upon the pressures and wave energy produced by the main pumps 100 and 101.

Brandon's prior design of the plungers in pumps 100 and 101 used plungers with cavities (side inlets) and discharge valves acting as their ends to allow fluid to pass from those plungers during reverse strokes—then for the discharge valves to close and compress fluid forward of the plungers during their forward strokes. This imparted action to the column of fluid beyond the pump plungers producing wave forms, etc.

However, those pumps were redesigned by Brandon, their plungers revised from 2" diameter to 4" diameter with inlet openings at the rear of the main plunger bodies, instead of the side inlet openings. When the pump plungers are forced in reverse against fluid delivered to their cylinders from feed pump 26, a compressive force was delivered against the supply of fluid delivered from feed pump 26.

The Brandon style of pumps did not include check valves used as inlet valves to close against the reverse action, and as a result, pumps 100 and 101 could not ratchet increasing pressure. That is, the intake openings of pumps 100 and 101 were connected by a common line to the conduit from feed pump 26 which allowed fluid to oscillate between the pumps. As such, the reverse action of pump plungers might deliver as much force back against pump 26 as they might deliver ahead.

SUMMARY OF THE INVENTION

A primary object of this invention is to provide an apparatus and a method for producing high frequency vibration in a liquid medium wherein control of the amplitude and the frequency of the vibrations produced within the liquid medium occurs with greater efficiency, accuracy, precision and control.

A further object of the invention is to provide an apparatus and a method for creating high frequency vibrations (sonic, ultrasonic or infra sonic waves) as an energy carrying wave in a medium, usually liquid such as water or oil, wherein all of the characteristics of the wave can be controllably varied and applied to widely diversified uses such as tunneling, drilling, mining of various minerals, reduction of ores, pumping, oil well use, various pressing applications, extrusions of materials, recrystalizations of materials to increase strength, ice breaking, structure deforming, prestressing or compacting of materials, quarrying, dyeing of fibers, disintegration of coal, rock and limestone and many other uses.

More particularly, a very important object of the invention is to provide an apparatus and method specifically adapted for use in oil and gas subterranean formations and effectively treating the same by fracturing, acidizing, cementing, cleaning, water and gas floodings in secondary recovery techniques, drilling, and testing operations relative to any of the above.

A still further important object of the invention is to provide an apparatus and method whereby the high frequency vibrations, the character of the high frequency vibrations and the like are controllably varied without substantial reverberation or return energy being allowed into the sonofrac machine and/or to the feed pump to the sonofrac machine which would otherwise dampen the desired wave characteristics. One means to accomplish the object of this invention is by improvements in said sonofrac machine or energy generating means which will carry high frequency waves of variable characteristics, controlled by an operator as to amplitude, frequency and strength in a fluid, usually liquid medium. This medium is then transmitted from the sonofrac machine to an object, an area or downhole subsurface formation to be treated. A positive pressure type of feed pump means, typically a high-speed plunger pump such as a simplex, duplex, triplex, or quintuplex is operative to feed liquid medium under pressure to the sonofrac machine. A fluid reservoir for supplying the liquid medium is provided with an inlet conduit to the feed pump. A standpipe or centrifugal pump or other means to provide an inlet pressure head of fluid to the suction inlet of the feed pipe is provided as one means to maintain sufficient supply of fluid to the systems and absorb reverberating and/or reflected wave energy from the sonofrac machine to the feed pump. Although the invention is preferably directed to and for use with liquids, other fluids, including gases or liquids containing gases, are capable of use within the scope of the inventive objects herein.

Additional improvements provide reverberation reduction by:

1) Separation of the liquid feed means to two, or more, main pumps wherein each main pump is then individually supplied with liquid;
2) The addition of an inlet check type valve, i.e. permits only one-way directional flow of fluids, on each feed line to each main pump;
3) The addition of a buffer control in each feed line to each main pump, e.g. using conduits or means to control reverberation by the assemblage of piping to the feed line having 'dead-end' zones within the piping, along with controls for the purpose, during operation, of preventing or minimizing harmonics within the generating unit and/or its components, while at the same time enhancing the effects of the harmonics downstream upon the objects being treated or at least prevent any diminishment of the produced waves to the objects being treated;
4) Providing control means to separately drive or operate and isolate a single main pump piston in a multiple pump apparatus, and to separately drive or operate and isolate a single cavitation valve; and
5) Separately supplying nitrogen gas dampening control to each pair of piston/cavitation valves.

Another important object of this invention is the creation of stress and strain relative to the object, e.g., subterranean formations to cause fatigue failure of the formation particles and thus increase the recoverability of the formation fluids, i.e., oil and/or gas. "Stress" in this instance is an external pressure force built up against the formation that creates "strain" or an internal structural pressure force that tends to alter the formation structure itself. This is accomplished with this invention by the build-up of pressure wave force employing kinetic energy from main pump(s) to create stress against and within the connected formation which in and of itself creates deformation strain within the formation structure which is a potential energy source until released. Using the cavitation valves, in timed sequence, the pressure (stress) is momentarily relieved to produce work from the return of the deformed and strained formation. This procedure is continued until the formation structure fails by fatigue. This is somewhat likened to the repeated bending of metal or iron wire which causes fatigue and resulting failure or fracture. The stress is the bending pressure force which creates strain within the molecular structure of the structure.

A further object of this invention is to provide improvements in apparatus and methods as described in the aforesaid Brandon patent, to create infra i.e. low frequency sonic waves which oscillate between the "face" of the oil formation, i.e. all of the contiguous formation surfaces and interstices exposed to the well bore, and the sonofrac main machine piston and the cavitation valve. The force of the (piston-valve) faces, generated by movement from the mechanical power source add energy as the waves complete each cycle. When a precise match of cycles (between "pushes" and oscillation) occurs, resonance is created. Resonance is caused or results when a periodic load of the same frequency as the natural frequency of a system is applied. Energy may be added to the system. Such an accumulation or intensification of energy will build up the amplitude of the vibration, and can continue until structural failure occurs. The creation of resonance generates tremendous additional force, pressures, strains and stress in the whole system, most importantly, at the face of and within the subterranean hydrocarbon formation. It is an object of this invention to adapt "frequency" of infra sonic waves to a precise and exact timing of cycles to produce such resonance. When resonance is attained in the system, the productive forces act against the contiguous formation surfaces of a relatively permeable subterranean formation and the relatively nonpermeable subterranean formations in which the wells have been drilled. In this invention with the improved fluid inlet corrections, the pistons of the machine create the basic pressures of stress/strain at the face of and within a subterranean formation. Intermittingly, the cavitation valves act both to create and to interrupt the stress/-strain force wherein the deformed formation structure and the fluids therewithin are momentarily relieved of the strain imposed thereon which might be defined as "virtual work" or the product of force time displacement. This procedure is repeated until the formation fatigues and breaks apart or fractures and separates the fluid within the interstices of the formation. The degree of fracture or disintegration is governed by the porosity and permeability of each separate formation with changes that enable an operator of the system to produce different vibrations, frequencies, amplitudes, pressures and/or wave energy forms to more successfully treat different types of formations. It is believed that the apparatus and methods of this invention also produce and/or generate sonic vibrations which are transmitted by and through the fluid medium within the interstices of the formation to create the stress/strain phenomenon of this invention.

To accomplish the methods of this invention, it was found necessary to modify the Brandon sonofrac apparatus in three (3) separate zones:

1) The #1 positive pressure feeder e.g., triplex pump zone which functions to provide fluid liquid volume at relative low pressure and at an efficient rate and volume to feed the main (prime) pumps forming the #2 zone.
2) The #2 zone, consisting of the main (prime) pumps which are the basic means to develop the initial working wave frequency or frequencies and wave pressure(s). The tremendous power created by the design and action of these main pumps cannot be efficiently utilized without the input action of zone #1 into the system.
3) The #3 zone consists of independent or selective actuation of the cavitation, a/k/a/"hammer" , valves which operate at predetermined (variable and controllable) intervals or in response to feedback from a formation to relieve the enforced strain within or to the applied formation.

The above three activity zones, described above, function, operate and are used to effectively "ratchet" pressures upward from zone to zone in the continuous operation of the system. The #3 zone is the final zone in the "ratcheting" of the pressure process, and it delivers the most crushing and fracturing effects of the process to the object being treated. This "peaking" activity of tremendous and, as yet, unmeasured upper limits of pressure, amplitude and resonance which are superimposed shock waves and impulses of great magnitude is perhaps the heart of an effective and productive work of the system.

The invention uses kinetic and potential energy to deliver intermittent pressure stress with resulting reversal of strain deformation, causing work and resulting fatigue.

The use of high pressure, frequencies, vibrations, amplitudes, wave energy forms, etc. (components) of the fluid within a pipe leading from the pumps will in and of themselves strain, deform and lengthen the conduit to the worked object, (e.g., well formation) to its yield strength and thereby enhance the strain for release when strain is released.

The development of this effective pressure is achieved by reversal of stroke of the pumps 100 and 101, which forces the fluid inside the plungers against the closed inlet check valve, which does not permit any flow back through these check valves; therefore, the pressure of the reverse stroke forces the discharge valves at the end of the plungers to open and to discharge the fluid into the system.

The main piston pumps 100 and 101 of this invention distinguish over the Brandon concepts because fluid is fed into cavities within their plungers, by an auxiliary pump 26 when those 100 and 101 pump plungers are in a forward position. Fluid can be fed through the discharge valves (located in the ends of those plungers) because the added check valves enable infeed pressure to overcome the pressure of fluid that may exist in front of those plungers. The fluid delivered to the plungers reacts against inlet (check) valves located at entrances to those pumps 100 and 101 thereby compressing and forcing fluid from the ends of the pump plungers out and away from the pumps 100 and 101. Effective pressure is developed by reverse action of those pump plungers to force fluid from the pumps 100 and 101 into the system on the forward stroke of the pump.

Further, the addition of inlet valves (check valves) ahead of the inlets of those cylinders enables the pumps to receive fluid from pump 26 into their plunger cavities then close inlet valves behind them, compress and force the entrained fluid forward through the discharge valve in the piston head, thus building pressure plus adding force (energy) to the full column of water beyond the ends of the discharge valves in the pump plungers.

DETAILED DESCRIPTION OF PREFERRED EMBODIMENT

Before explaining the present invention in detail, it is to be understood that the invention is not limited to its application to the details of construction and arrangement of parts illustrated in the accompanying drawings, since the invention is capable of other embodiments and of being practiced or carried out in various ways commensurate with the claims herein. Also it is to be understood that the phraseology or terminology employed herein is for the purpose of description and not of limitation.

Figure 1:
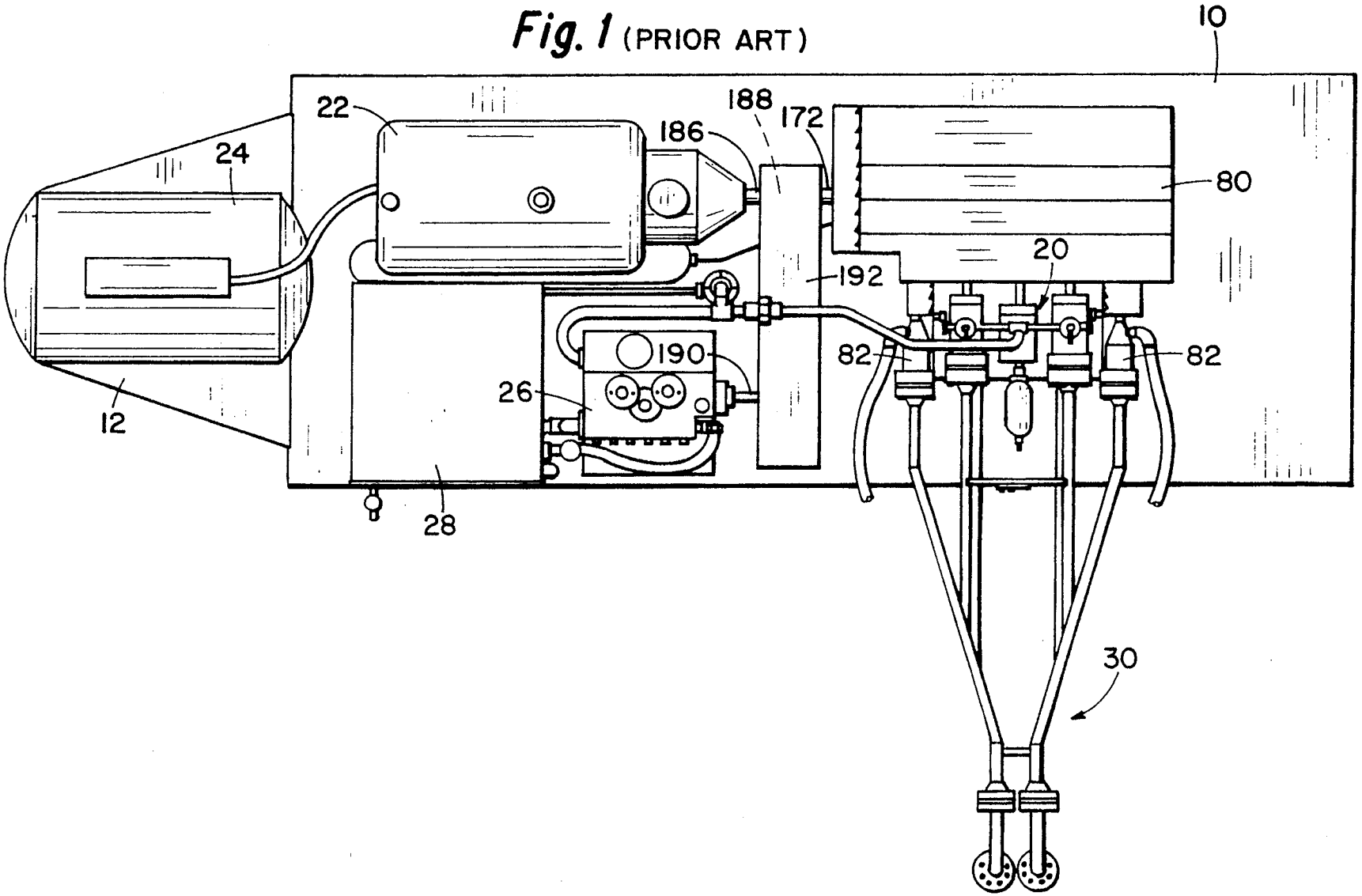
Fig. 1 (PRIOR ART)
FIG. 1 is a top elevational view of the prior art apparatus taken from U.S. Pat. No. 3,981,624 incorporating and showing the relative arrangement and the location of the various subassemblies of the apparatus to which this invention is adaptable upon a mobile base.

Referring now to FIG. 1, which is the apparatus of the prior art found in FIG. 1 of U.S. Pat. No. 3,981,624 dated Sep. 21, 1976 and incorporated herein by reference. The apparatus includes a mobile supporting frame which may comprise the bed of a truck or trailer, being illustrated in the drawings as consisting of a trailer bed 10 of any suitable design which has at its forward end a vertically offset or raised portion 12 which is adapted to be supported and secured as by a conventional fifth wheel assembly to the rear of a tractor type vehicle. It is upon a similar trailer bed 10 that all of the elements and subcombinations forming the preferred form of the apparatus in accordance with the invention are permanently mounted and secured in an operative relation for use or in a compact stored condition for ready transportation.

Placed upon the trailer bed is the so-called "sonofrac machine" or energy wave generator consisting of variable stroke pumping units generally designated by the numeral 100 and 101, an internal combustion engine 22 which is the prime mover or power source for the apparatus which drives, via shaft 186, the power take off 192, the sonofrac machine 80 and feed pump 26 using drive belts 188 via respective shafts 172 and 190. A storage tank 24 for fuel, typically LPG, such as butane, propane or the like, is provided for the internal combustion engine. Mounted upon the trailer bed is a tank 28 constituting a reservoir for fluid to be supplied to the feed pump 26. A Y-tube assembly 30 is operatively and detachably connected to the variable pump units 20 for delivering the high frequency wave forms generated by the pump units 20 to the surface or object to be treated and for receiving the fluid medium discharged from the pump units. The overall purpose of the apparatus was to provide a variable stroke and variable capacity pumping unit capable of imparting high frequency vibrations and energy carrying waves upon the fluid medium operatively contacting and/or discharged by the variable stroke pump whereby such vibrations and waves may be transmitted by the fluid medium to the surface, object or area that is to be treated by the same.

Figure 2:
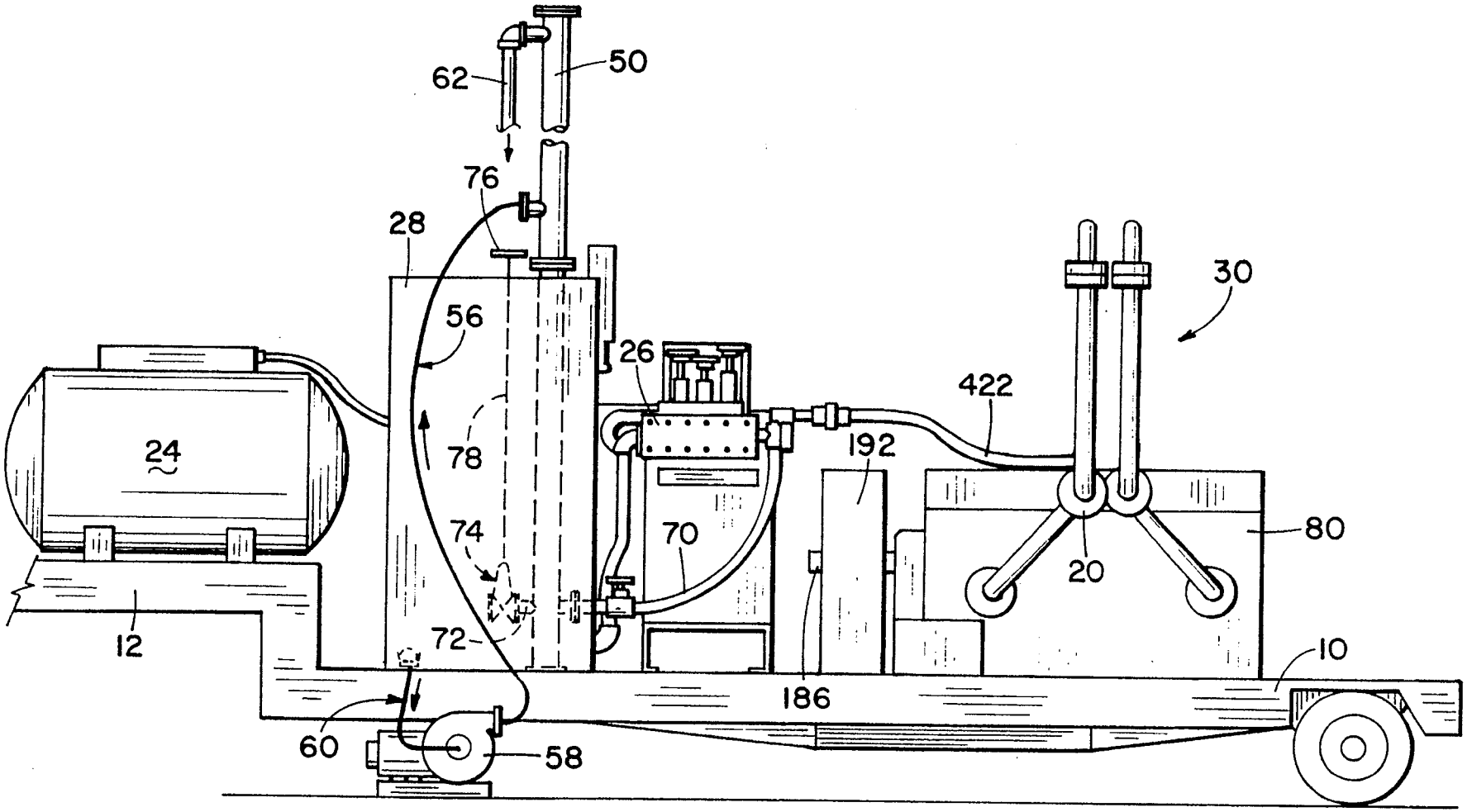
FIG. 2 is a side elevational view of the apparatus shown in FIG. 1 but including some of the improved concepts of this invention.
Figure 3:
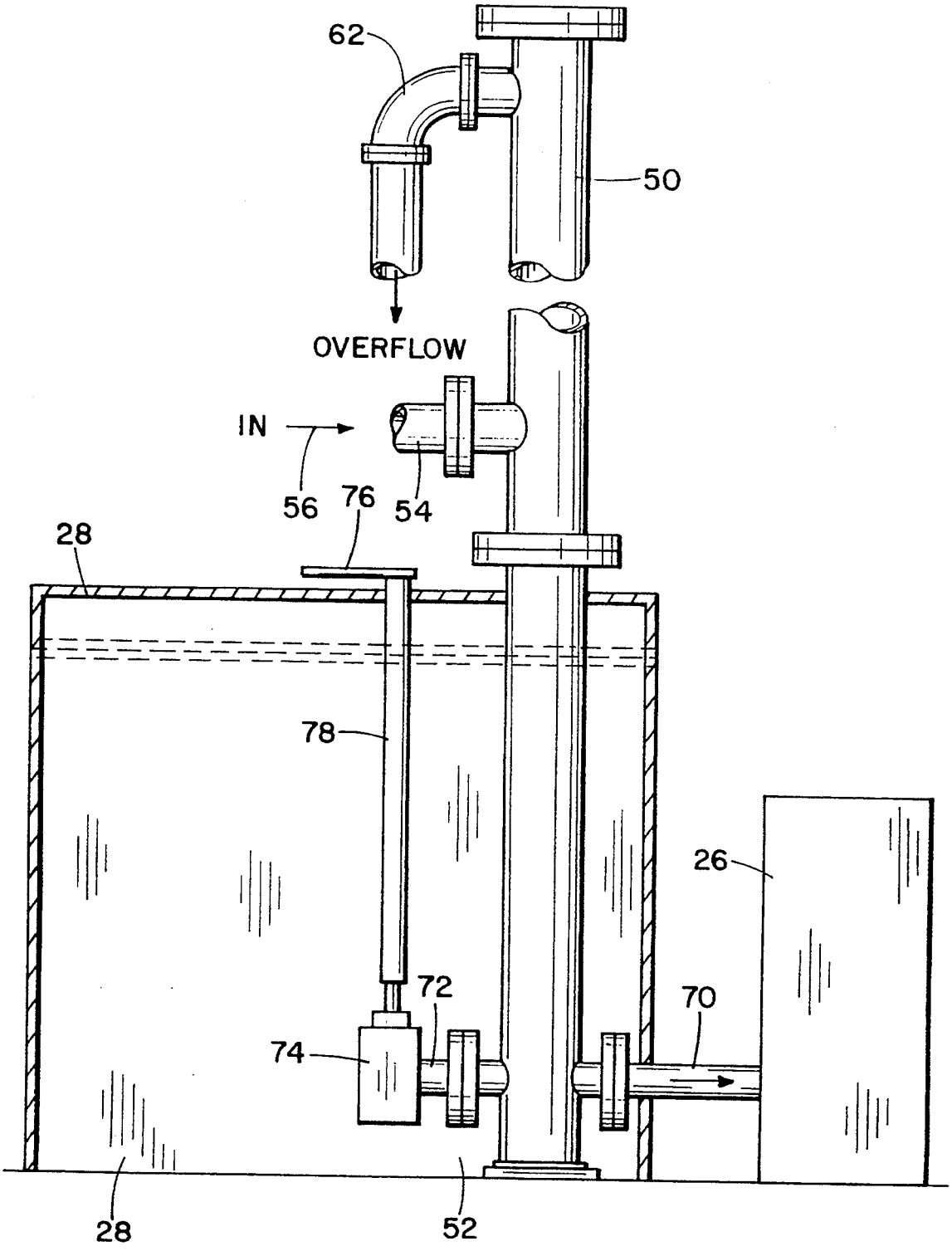
FIG. 3 is a partial side elevational view showing the portions of the zone 1 invention enlarged.

FIGS. 2 and 3 represent phase 1 or zone No. 1 of an improved sonofrac machine wherein the embodiment shown in FIG. 1 has been modified as part means to eliminate unwanted reverberations in the system by the incorporation of a means to create a positive hydrostatic head comprising a standpipe 50 which is attached to and extends internally into the fluid, i.e. liquid reservoir 28, the bottom end thereof being rigidly attached to the bottom 52 of the tank. It should be understood, however, that the standpipe 50 may be located exteriorly of the reservoir with proper modification of the piping, etc. An inlet 54 to the interior of the standpipe 50 is connected via conduit 56 to the outlet of centrifugal pump 58 with the inlet 60 (FIG. 2) being in communication with the interior of the liquid reservoir 28. Thus, in operation, the standpipe 50 is maintained with a constant hydrostatic head of liquid, with any overflow passing through conduit 62 from the upper end of the standpipe 50 back into the liquid reservoir 28. At the lower end of the reservoir the interior of the standpipe is in communication with the inlet line 70 to a positive feed pump 26, the pump 26 being preferably of the type known as a "triplex pump". An additional inlet to standpipe 50 and/or the feed pump inlet 70 is found at the lower end of the standpipe and identified by the numeral 72. A valve 74 operated by an exterior handle 76 by way of extension 78 is operative to permit passage of liquid medium from reservoir 28 directly into the standpipe and/or to the inlet 70 of pump 26 as need arises. The outlet of the pump 26 flows through conduit 422 to the sonofrac machine for use as described in the aforesaid Brandon U.S. Pat. No. 3,981,624.

Figure 4:
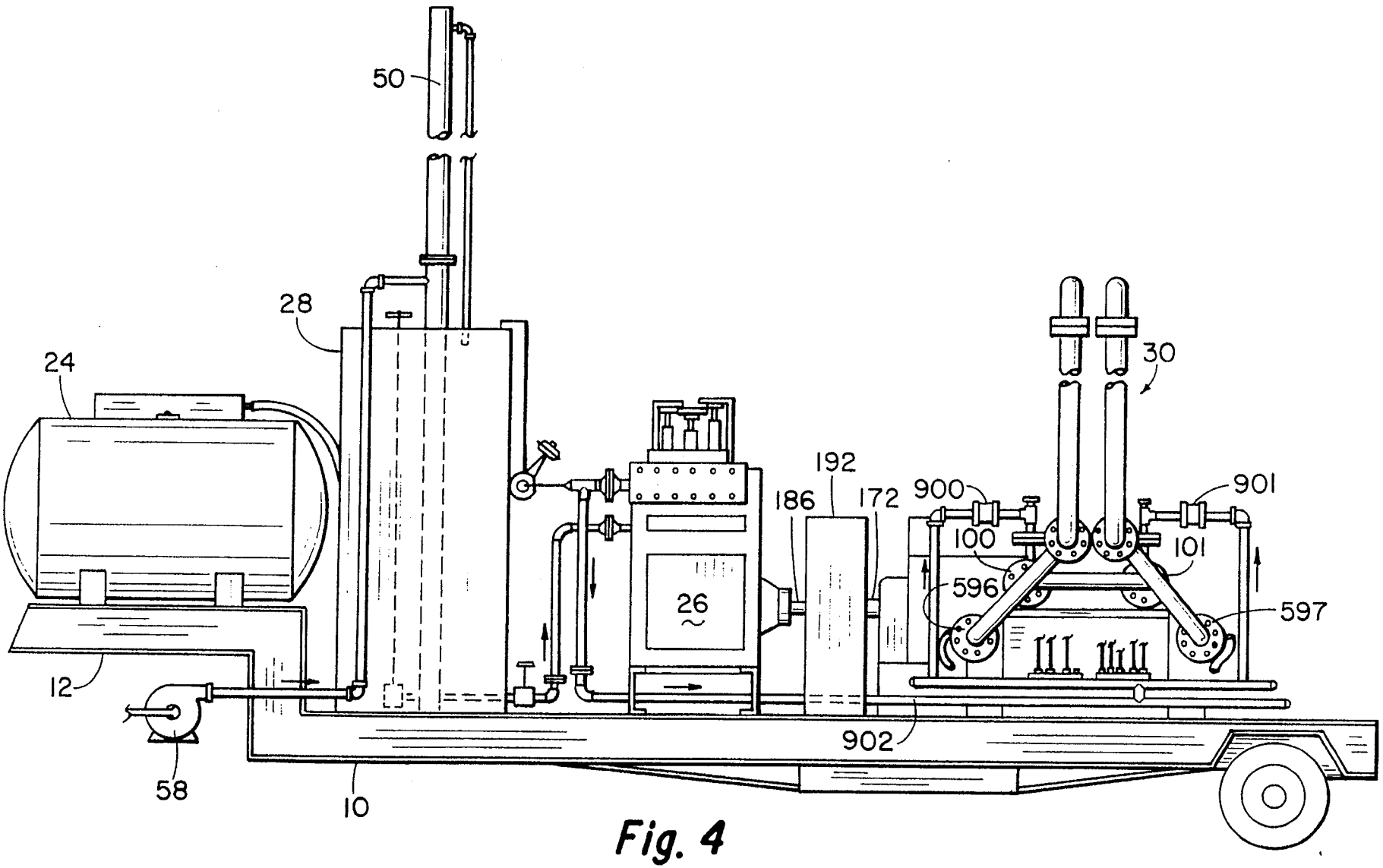
FIG. 4 is a side elevational view of an alternate embodiment of the invention.

As a typical example, the standpipe 50 of this invention comprises a 152 mm pipe about 6 meters in length made of schedule 40 steel or PVC. The valve 74 may be of ball or butterfly type, the outlet line 70 from the standpipe being 101 mm pipe. In normal operation, the liquid supply to the pump 26 comes entirely from the standpipe to supply a continuous source of pressure obtained by the column of liquid medium, i.e. water, which is believed to additionally guard against cavities or gaps in the suction to feed pump 26. Heretofore reciprocating pumps have traditionally used air chambers downstream from the pumps to smooth out pressure and flow. This invention provides a change of this concept by pacing adequate volume and pressure ahead of the frequency generating system to prevent liquid starvation of the main pumps 100 and 101 (see FIGS. 4 and 5). It has been found that a constant column of water appears to provide one means to block against reverse shocks attempting to travel back from the sonofrac machine 30 into the feed pump 26.

Although the apparatus herein has been described relative to the use of a standpipe 50, it is believed that similar continuous controllable supply of liquid could be provided by using a separate centrifugal pump providing flow of liquid to the inlet of the triplex pump 26, the purpose being to provide an over supply of liquid thereto and thus, the invention provides a substantially continuous and controllable volume and pressure of liquid via outlet line 422 to the sonofrac unit 30. In some instances a check valve may be placed in outlet line 422 to provide control over feed back or reverbratory waves to the feed pump 26.

FIGS. 4 through 7 depict additional improvements to the invention, in this case zone No. 2. As hereinafter described, each main pump 100 and 101 is individually supplied with liquid via conduit 902 through the buffer system hereinafter described. Inlet check-type valves 900 and 901 have been added on each feed line to the main pump which permits only one way directional flow to each main pump. A buffer or reverberation control piping 903–907 and 908–913 have been added to the feed line in the form of four different areas of dead-end piping.

Figure 5:
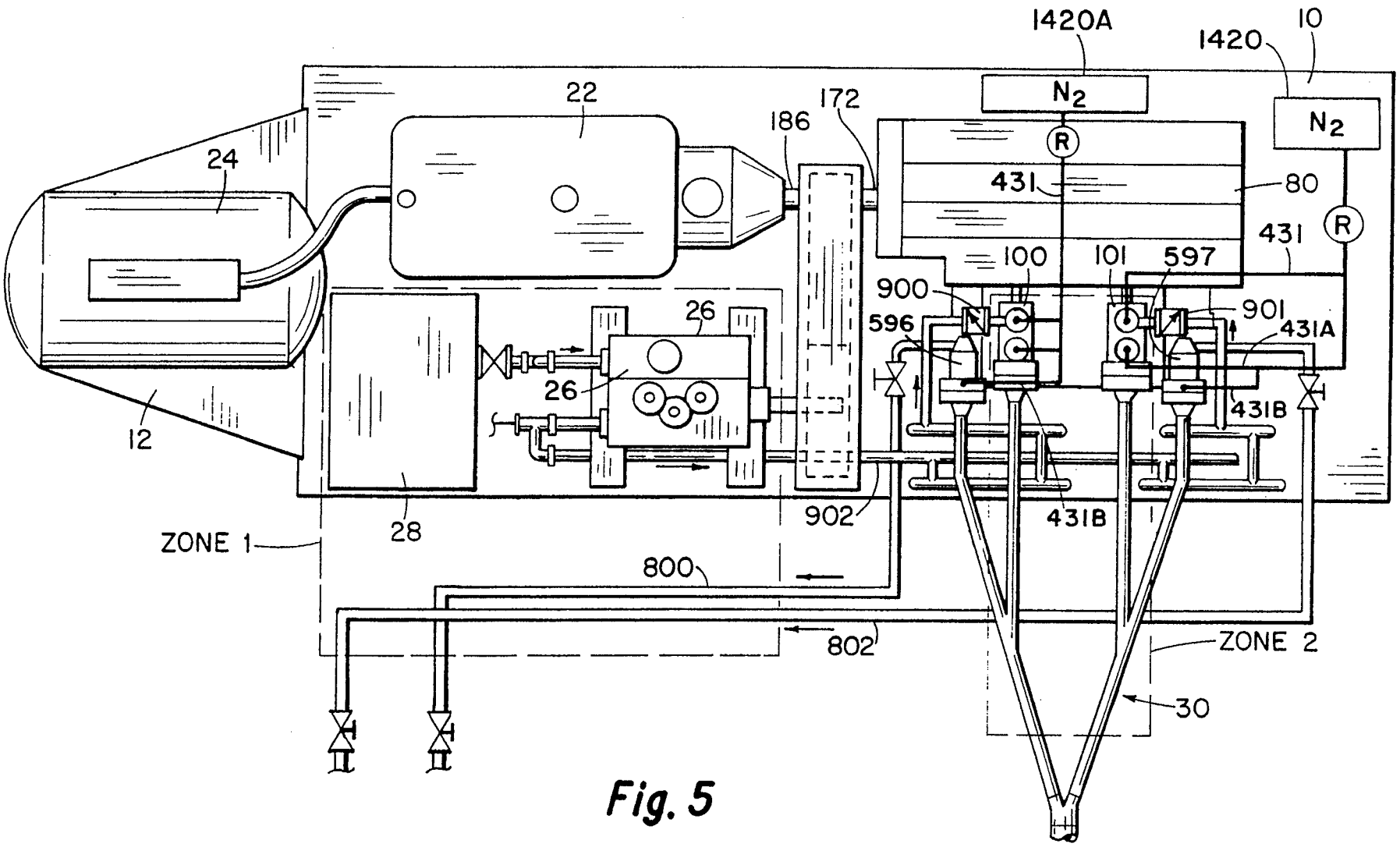
FIG. 5 is a top view of the apparatus shown in FIG. 4.

As shown in FIG. 5, separation of the process into different "stages," or "zones," endows the process with the ability to "overlay" or "add to" the creation of pressure or vibrations. In the first and second "stages" or "zones," additional pressures, or vibrations, are created. The unique intermittent nature of these actions enables severe and stressful amplification forces to be applied at predetermined times during the operational cycles.

In zone No. 3, (see FIG. 6) momentary relief of the stress/strain forces and heretofore described results from operation of at least one, two being shown of the "hammer" or "cavitation" valves 596 and 597 by the machine 80 (see also FIGS. 39 and 42 of U.S. Pat. No.

3,981,624) and provide additional sources of fracturing, breaking, or releasing actions at the point where treatment fluids meet the face or interstices of the objects to be treated. Passage of the waves and generated forces from the carrier medium treatment fluid (at the exact moment of transition or passage) to the object to be treated causes the release of the waves and generated forces into the object to be treated. In other words, a change of "wave carrier medium" from treatment fluid to treatment object cause the desired action to occur.

Other systems utilize steady and continued force or pressure to accomplish their work. However, one of the unique and different aspects of this system is that it does not use steady and continued force or pressures. The forces described herein are intermittent which is believed to create and accentuate the stress and strain upon the formation that is being generated and transmitted by the specific concepts and implements as assembled in this apparatus. In addition to the intermittent nature of this system, the additional intermittent shocks on top of the primary carrier forces from pumps 100 and 101 is a further unique concept, enhanced by the forces of stress and strain as described above.

The understanding of stress/strain laws, mechanical or virtual work, creep, conversion of energy, forces, displacement, etc. is difficult. The concept of causing work inside a porus or permeable formation containing various types of liquids and gases is a principle of this invention to cause repetitive movement of the contiguous elements within the formation, thereby creating separation of those elements i.e., the formation itself and release of the fluids therein. Such work is comparable to repeated bending of a piece of iron wire, wherein the bent area becomes heated from the energy of bending, the physical structure is changed and the wire finally breaks. In this invention, the internal penetration of a formation with stress forces, putting the formation being treated under strain which is relieved at chosen times, converts applied energy through the oscillating forces to open channels, pores and cause fatigue failure of the strata, etc. In other words, it is the use of internal mechanical work inside a formation that is the object of this invention. The Brandon patents are improved upon herein by a system of inlet check valves, a tuned buffer labyrinth system and intermittent operation of the cavitation valve system are essential to accomplishing the desired results.

Figure 6:
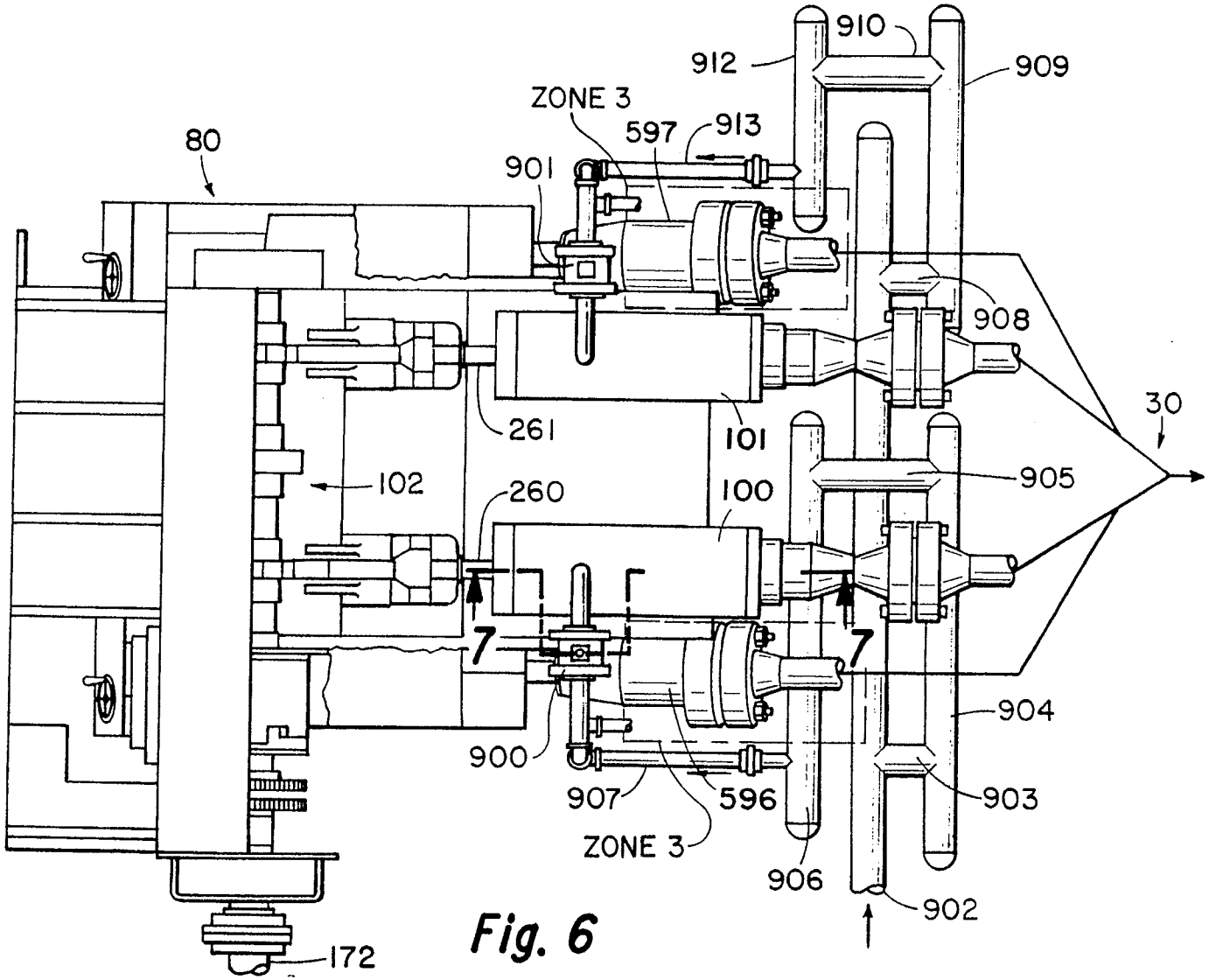
FIG. 6 is a representation of some of the improved apparatus of this invention.
Figure 7:
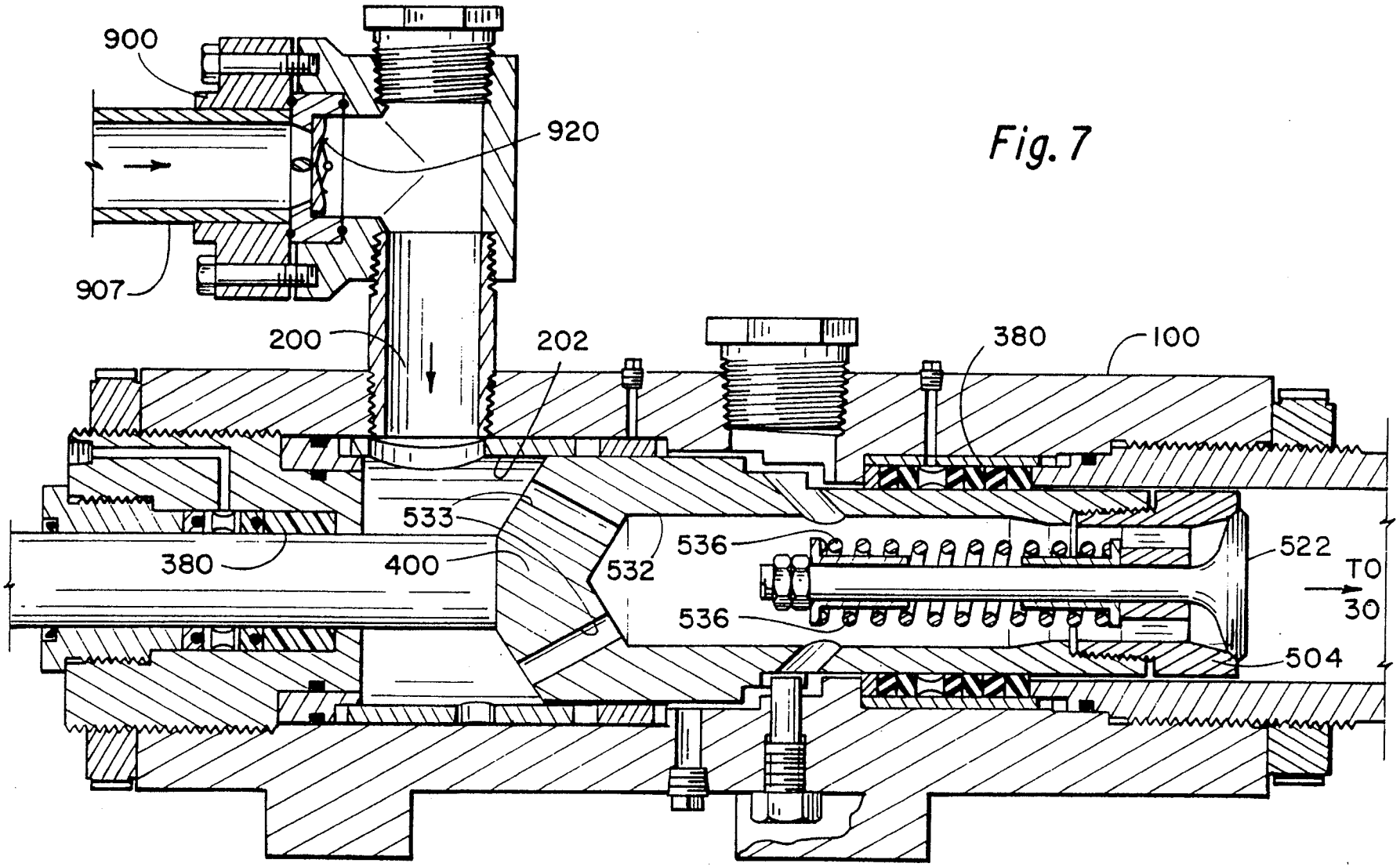
FIG. 7 is a partial sectional view of a main pump taken along the line 7—7 of FIG. 6.

Referring now to FIGS. 4–7, the machine comprises reciprocating main pumps 100 and 101 which are reciprocated by the reciprocating power system and the crank assembly generally designated by the numeral 102, being powered by shaft 172 from engine 22. Power from the crank system is transferred to pistons via connecting rods 260 and 261 (see FIG. 6) to the respective main pumps 100 and 101. FIG. 7 depicts a cross-sectional view of the main pump 100, including a cross-section of the added check valve body 900 having a flapper valve and seat 920 with a similar check valve 901 for pump 101. The outlets from the main pumps are directed to the Y-tube assembly 30 and thence to the zone of treatment, not shown.

Specifically, two check valves 900 and 901 along with the buffer liquid piping system 902 through 910 enable attainment of the effects of the system's intermittent characteristics.

The check valves 900 and 901, one for each respective variable pump 100 and 101, will assist the standpipe 50 pressure head in preventing recoil pressure from returning to the #1 zone pump 26 by migrating or absorption thereof in the manifold piping, labyrinth, system 902–910 when the two variable pumps 100 and 101 move in each of their backward strokes, thereby permitting intake of fluid. In the prior apparatus shown in the Brandon patents, fluid supply pump 26 received, and absorbed, some recoil wave action created not only by the two variable pumps 100 and 101, but also by the two cavitation valve pumps 596 and 597 (#3 zone) when the two variable pumps 100 and 101 were each in their separate fluid intake part of the operating cycle.

In the prior sonofrac machine recoil from one of the two variable pumps 100 would travel to the other variable pump 101, or vice versa, when the liquid intake backstroke of one variable pump was not at the "exact" same time as the exhaust (or pump) stroke of the other variable pump and thus, produce a negative effect. The sonofrac concepts of Brandon included the ability to vary wave formation by changing the phase of the two pumps operating cycles in relation to each other. However, this did not prevent the negative effects described heretofore. The addition of check valves 900 and 901 and the H buffer piping configuration 902 through 913 will enable the system to "ratchet" in two different steps the wave generating pressure to be delivered by the system to the area, surface or object to be treated without producing wave cancellation or negative reverberation. To describe this phenomenon relative to this invention requires reference to the prior art sonofrac system shown in FIG. 1. Fluid was supplied to pumps 20 via common conduit 422. There were no inlet or check valves to hole fluids delivered to the pump cylinders and therefore the pumps were prevented from "ratcheting" or increasing pressure, at least with consistent performance, above that delivered by the feed pump 26. Reference is made to FIGS. 32–35 of Brandon U.S. Pat. No. 3,981,624, wherein outlet valves 522 aid in producing and delivering fluid wave forms directly away from the pumps without passage through outlet valves in the outlet conduits.

Figure 8:
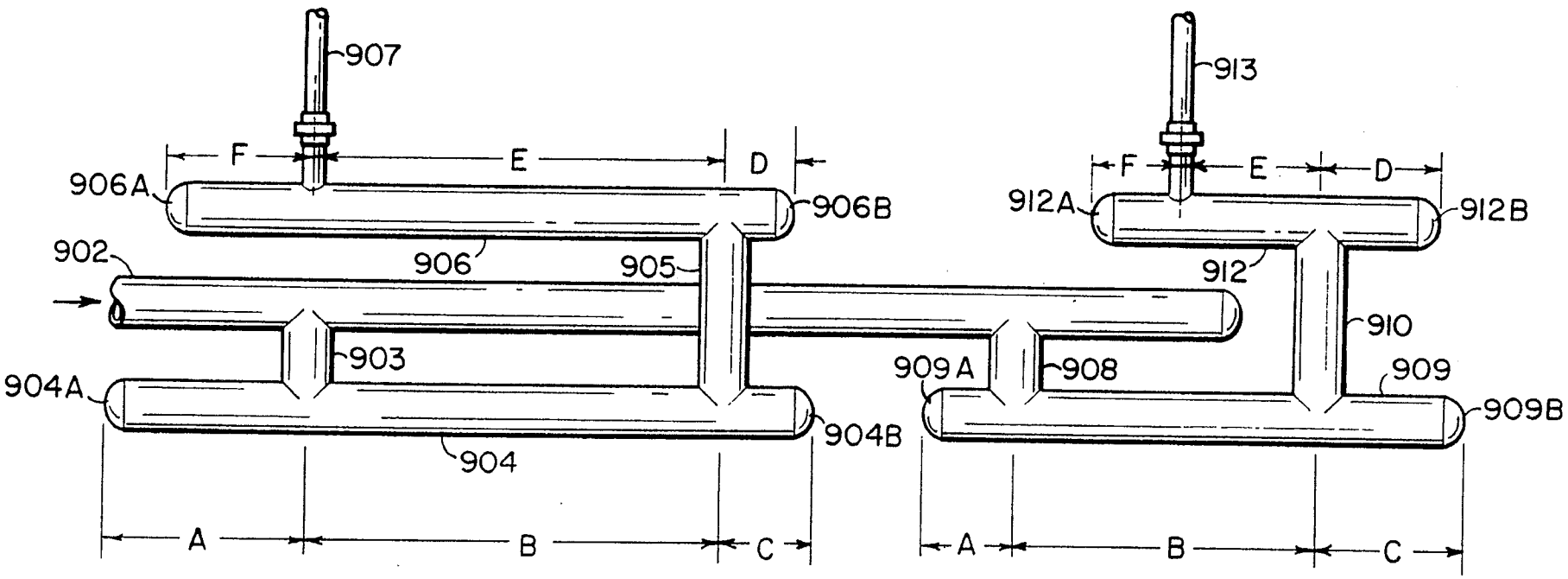
FIG. 8 is a view of the conduits forming the buffer system of the invention.

Referring to FIGS. 6 and 8, buffer manifold configurations of the fluid supply line comprises at least 3 or more different lengths of pipes. Inlet 902 connects with the inlet system to pump 100 and check valve 900 via conduits 903, 904, crossover 905, conduit 906 and 907 to the check valve 900. Similarly, conduit 902 supplies liquid to pump 101 via crossover 908 to pipe 909, second crossover 910, pipes 912 and 913 to check valve 901. It has been found that this improved system acts diminish recoil of wave energy and/or eliminate upstream harmonics produced by the two variable pumps 100 and 101 and the two cavitation valves 596 and 597. These dead end pipes aid in absorbing and deadening any recoil actions which may pass in fluid moving in opposite direction from the fluid movement direction during times when the two check valves open to permit the passing of fluid from supply feed pump 26 to the two variable pumps 100 and 101.

The buffer described and shown in FIGS. 6 and 8 acts as a column of fluid to cancel, dispense and convert vibratory, harmonic, reverberations that may enter that particular column. There are two separate buffer systems: one system for each of the main pumps 100 and 101 pistons. Each buffer system is a labyrinth system of at least three main branches. For instance, as described in FIG. 8 the three main branches to inlet pipe 907 are 902, 904 and 906. Similarly, the inlet 913 is supplied via branches 902, 909 and 912. Conduit 904 has closed ends 904A and 904B, while conduit 906 has closed ends 906A and 906B with series connected side inlet/exit conduits 903, 905 and 907. Similarly, the inlet to pump 101 includes closed ends 909A and B and 912A and B and series connected side inlets/exits 908, 910 and 913. The tubular space between those parts and the deadened extensions of varying lengths which act not only to avoid reinforcing any incoming recoil vibratory action that may by-pass the open check or inlet valves 900 and 901, but also to break incoming recoil action into a different frequency thereby generating different or counteracting frequencies in separate steps, and to dispense, or cancel the frequency received. The energy of incoming recoil forces is thereby transformed into heat.

A minimum number of three tubes used provides and insures formation of different frequencies rather than the multiples formally formed by doubles or even multiples in their harmonic.

Further, the separation of a column of fluid into tubes of varying lengths with side inlets and outlets avoids direct transmission from column to column through their respective axis. Each section of each tube as shown in FIG. 8 is of a different length in each tube. That is, tube 904 has Sections A, B and C, each of different lengths. Similarly, tube 906 has Sections D, E and F of different lengths. The same concept is carried into inlet system 908–913 for pump 101. Because of this difference in lengths, reverberations in each chamber are different. The whole purpose is to dampen any upstream traveling wave effects and reduce damage upstream to the fluids supply pump 26. For example, check valves 900 and 901 open at intervals to admit fluid to pistons 100 and 101 respectively. This opening allows pressures and wave forms to move upstream through the open check valves or as they open and thence upstream through the system back even to the supply pumps 26. The buffer as described in here acts to substantially reduce and/or prevent any such damage. The lengths of the pipes and all sections of pipes, should be different and ratios of length to the diameter of each section should be an odd, not even, number.

It is believed that the action by the buffer of closed end tubes breaks down (reactions from pumps 100 and 101) waves, sonic or otherwise, internally into waves, or harmonics, of different frequencies, while (at the same time) adding odd harmonics like 3rd, 5th, 7th, etc. and in this process the effect of the initial reaction is reduced into multiple reactions of lower intensity plus converting some of the initial intensity into heat.

The use of harmonics of different frequencies to cancel unwanted resonance and harmonics that may be fed back from the action of pump 100 and 101 toward the feed pumps is prevented by installation of the buffer system.

The frequency of wave action, or oscillations, reverberations within or entering cavities of different lengths develops new frequencies in a given cavity from the frequency entering that cavity—operation has shown cancellation of the initial frequency.

This cancellation is from within the system. The introduction of externally formed frequencies is widely used to cancel sound or sonic or vibratory frequencies. This buffer uses progressive formation of varying frequencies within and without the introduction of external action.

Figure 9:
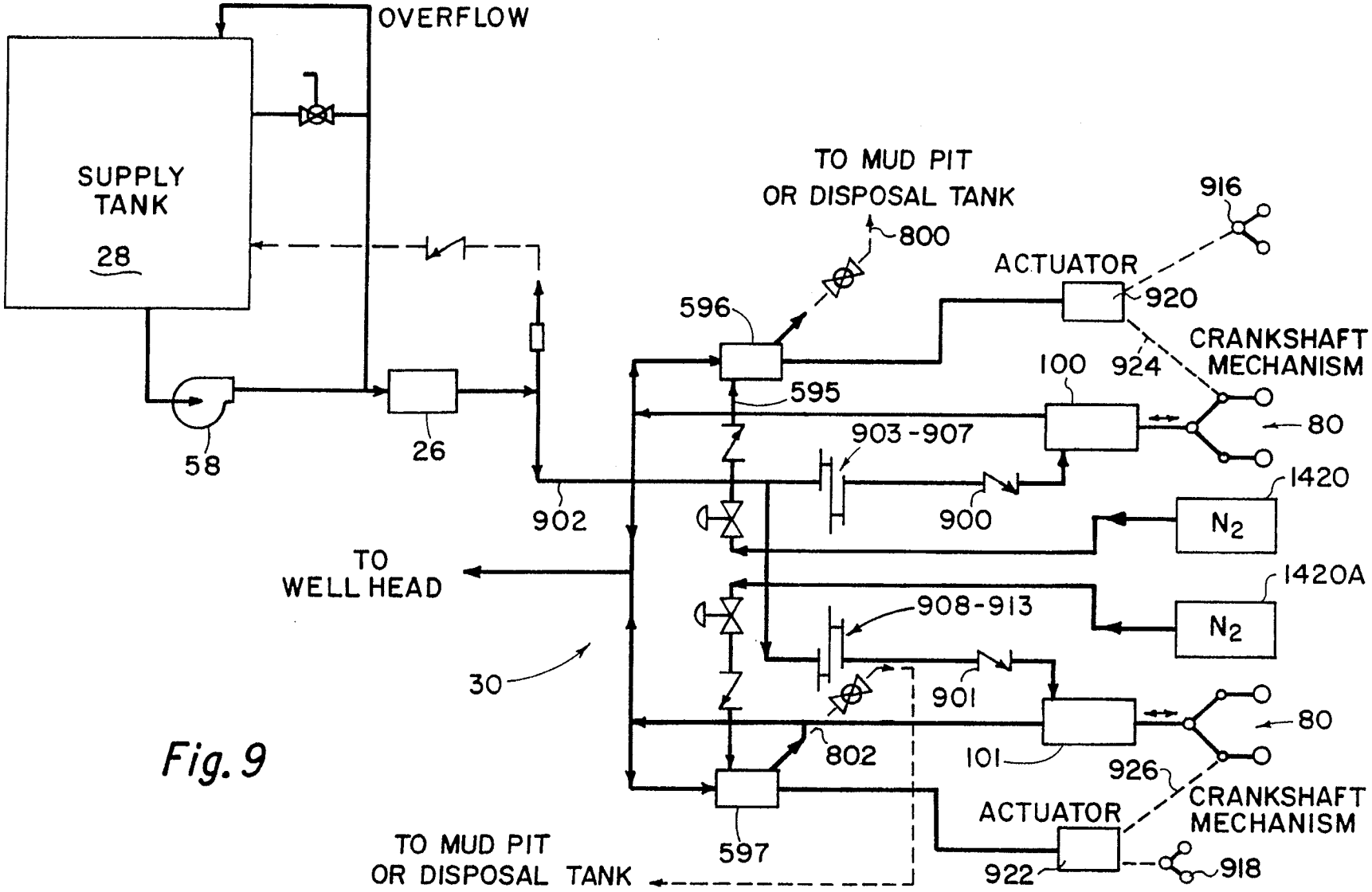
FIG. 9 is a schematic of the flow of fluids, i.e. treating liquids and gases ($N_2$) used with the apparatus.

As shown in FIG. 5, further improvements to the sonofrac machine as described in U.S. Pat. No. 3,981,624 to achieve the purposes of this invention is provided by separate nitrogen supply tanks 1420 and 1420(A) and respective conduits 431 and 431A to the separate main pumps and cavitation pump systems. This is also shown in the schematic piping diagram of FIG. 9.

Fluid is delivered to their inlet cylinders by triplex (positive displacement pump) through a buffer unit and a check valve to a rear inlet of a main pump cylinder.

The pump plunger acting longitudinally within the cylinder moves by action of the pump crankshafts. Therefore, there is displacement within the intake section of each pump plunger and during each revolution of the pump crankshafts.

The foregoing calculation and statement considers displacement only and does not consider the flow of fluid from the triplex pump that can pass through this pump plunger and downstream of that plunger by pressure from triplex pump (26) velocity of the fluid, the lag in action of the valves, inlet and outlet, and the velocity of the fluid passing through each pump section. The pump plunger contains an inner cylinder.

A movable spring loaded valve at the end of the cylinder can open by pressure from fluid delivered by the pump 26 and inertia of the fluid when this pump plunger is suddenly moved and a change of direction occurs, causes the weight (inertia) of fluid inside the plunger to act against the valve at the end of that plunger (against or away from the valve—depending on direction).

Also, the passage of fluid through these cylinder, plunger and downstream cavities from each pump 100 and 101 (are basically alike) into a "Y" connection of pipes 1.93"(49.02 mm) I.D.=2.94 square inches (18.97 sq. cm) and meeting at that "Y" then to meet "shocks" from the alternate reaction of two different cavitation valves. All produce conditions that can vary widely.

The Sonofrac machine comprises two pumping units of like construction powered from a common drive but arranged to discharge through a "Y" connection to a single line but with their cycles 135° apart.

The difference in diameter dimension of the cavity in each pump, from rear section of pump to forward section of pump, is from "large" to "smaller"—and the resultant constriction of fluid moving through this "reducing diameter" conduit, from the rear section of the pump to the front section, (gradually moving through a "larger" tube through a "smaller" and "smaller" tube-)—adds force and pressure to the fluid as each diameter stage (reduction) is passed.

Dissipation of wave energy into recoil or reverberation action in the past has diminished wave energy and power transmitted forward through the fluid column to the desired point of contact with the area, surface or object to be treated. The check valves 900 and 901, the buffer piping and/or the separated nitrogen dampening are directed to increase and/or sustain the wave energy created by the wave generators 100 and 101 and cavitation valves 596 and 597.

There are three "ratchet" steps. The first "ratchet" step is accomplished and created in the #2 zone, by the operation (with diminished recoil) of the two variable pumps 100 and 101.

The second "ratchet" step, also in the 2nd zone, is greatly enhanced over Brandon's prior art U.S. Pat. Nos. 3,765,804; 4,022,275, etc. because the operation of the two check valves will now hold (downstream) the increased stress creating pressures and enhanced vibrations generated by the two variable pumps 100 and 101; said increases and enhancements occurring because of the addition in the system of the two check valves 900 and 901 and the series of "buffer" pipes 902–912 which may be of any size, preferably about 101 mm in diameter.

The third "ratchet" step is accomplished and created in the 3rd zone, by the operation of the two "hammer valves" 596 and 597 (also described as "cavitation valves").

Broadly speaking, this embodiment of the invention comprises three interconnected groups, each designed to perform specific functions.

First, a feed pump 26 means, typically a high-speed multiple plunger, operates to feed fluid to the sonofrac machine. A fluid reservoir for supplying medium is provided with an inlet conduit to the feed pump 26. A standpipe 50 or means to provide an inlet pressure head of fluid to be suctioned inlet of the feed pipe to the main pumps 100 and 101 is provided to absorb reverberating and/or reflected wave energy from the sonofrac machine back to or through the feed pump 26.

Second, the liquid feed means is separated to the two main pumps 100 and 101 to ensure that each pump is individually supplied with liquid. The buffer is added in the separate feed line to each pump for reverberation control in the form of closed end tubes of varying lengths and with all inlet, outlet and cross connections at varying lengths.

Addition of inlet check valves 900 and 901 and its flapper and valve seat 920 to the inlet of each main wave generating pump 100 and 101 to block reverse flow of liquid between the two pumps ensures ratcheting of pressure beyond the forward stroke of each pump plunger 400, as seen in FIG. 7 (which is shown as FIG. 32 in Brandon U.S. Pat. No. 3,981,624). Other components of the pump 100 include inlet conduit 200 communicating with cylinder 202 having seals 380 on each side thereof. The system and parts are held together by bolted connected means as shown.

Third, the requirement for inlet valves 900 and 901 to each pump also buffers the reactions of shock waves created by actions of hammer or cavitation valves 596 and 597 as seen in FIG. 6.

FIG. 7 describes a typical primary main pump 100 (pump 101 is the same) which includes cylinder space 202 which receives liquid via conduit 907, subsequent to the buffer system, through check valve 900 and flapper 920 into inlet 200. Piston plunger 400, its rod, unnumbered, are caused to reciprocate in the cylinder space 202. On the reverse stroke the fluid in the space adjacent inlet 200 enters piston chamber 532 via ports 533. Valve 522 unseats from valve body and seat 504 allowing fluid in chamber 532 to be directed to the outlet connection 30, thence to the object being treated. On the forward stroke valve 522 closes by the action of the fluid pressure forward thereof and spring 536 and the pressure wave thus created forward of the piston acts upon the fluid therein. At the same time new fluid is drawn from inlet 907 and enters conduit 200, cylinder space 202 and chamber 532 where the process is repeated.

One operational example of the improved invention is where cavitation valves 596 and 597 have been set to produce a primary hammer, shock wave, or pulsation at intervals of every ten revolutions of the main crankshaft. These valves have been set to produce an additional hammer, shock wave, or pulsation at intervals of every 100 revolutions of the main crank shaft 102.

The two main pumps 100 and 101 produce pressure and pulsation waves with each revolution of the crankshaft. Although these two pumps are usually set to operate separately at 135° apart, it is also possible to have them operate together (that is, at the same time) or at a variety of settings within the 360°, range or to be separately engaged and disengaged, i.e., have only one pump operating.

Once all of the forces generated by the machine are acting in concert, i.e. together at the same moment, fractures of core samples have been known to result and have produced recognizable spikes in wave pressures and sudden decrease of underground well pressures indicating breaks or fractures of the formations, followed by sudden and dramatic increase in volume of liquid entering into the well. All of this indicates below ground fracturing of such well formations.

Testing of the apparatus and method of this invention occurred on the L. D. Cook Lease, Section 28, Township 28 North, Range 13 East in Washington County, Oklahoma, Well No. 12 on the Parker Tract which indicated that substantial fatigue fracturing occurred in the limestone formation. Throughout most of the tests, the differential pressure occurring in the well opposite the formation being treated stayed within the range of about 8–12 psi (55–82 kPa), with the pressure increasing along with intermittent and chosen time operation of the cavitation valves until about ten minutes later when a substantial break in pressure occurred, creating differentials for several seconds from 78 to 129 psi (537–889 kPa), with the differential pressure then returning to the normal range until about one minute later when the pressure differential again increased from 57 to 142 psi (393–879 kPa) with the pressure differential then maintaining a substantially constant differential within the 8–12 (52–82 kPa) psi range for an additional 30 minutes. These peak differential pressures were indicative of the formation being fractured or otherwise treated.

Other modifications include the provision of an additional power source so that the liquid supply pump 26 can be operated at a difference speed from the main crankshaft 172 and its wave generating purposes. This would permit flexibility in the volume of liquid provided to the main pumps 100 and 101 in the full range of operating RPMs of the main crankshaft 102. That is, different volumes of liquid could be provided to pumps 100 and 101. In addition, it is possible to use an additional power source, i.e. different from the source of power for main pumps 100 and 101 or from separate source of power for the water supply pump 26 and for the two cavitation valves 596 and 597. That is, the cavitation valves may be also separately powered 916 and 918 engaged or disengaged, as by a clutch, as needed using any form of actuator 920 and 922 (see FIG. 9). This would permit some variation of the waves or pulsations created by the cavitation valves by having them operate at different desired times, speeds or cycles independent of the main pumps 100 and 101, although operation may be powered by the power source 80 as shown by the dotted lines 924 and 926.

Figure 10:
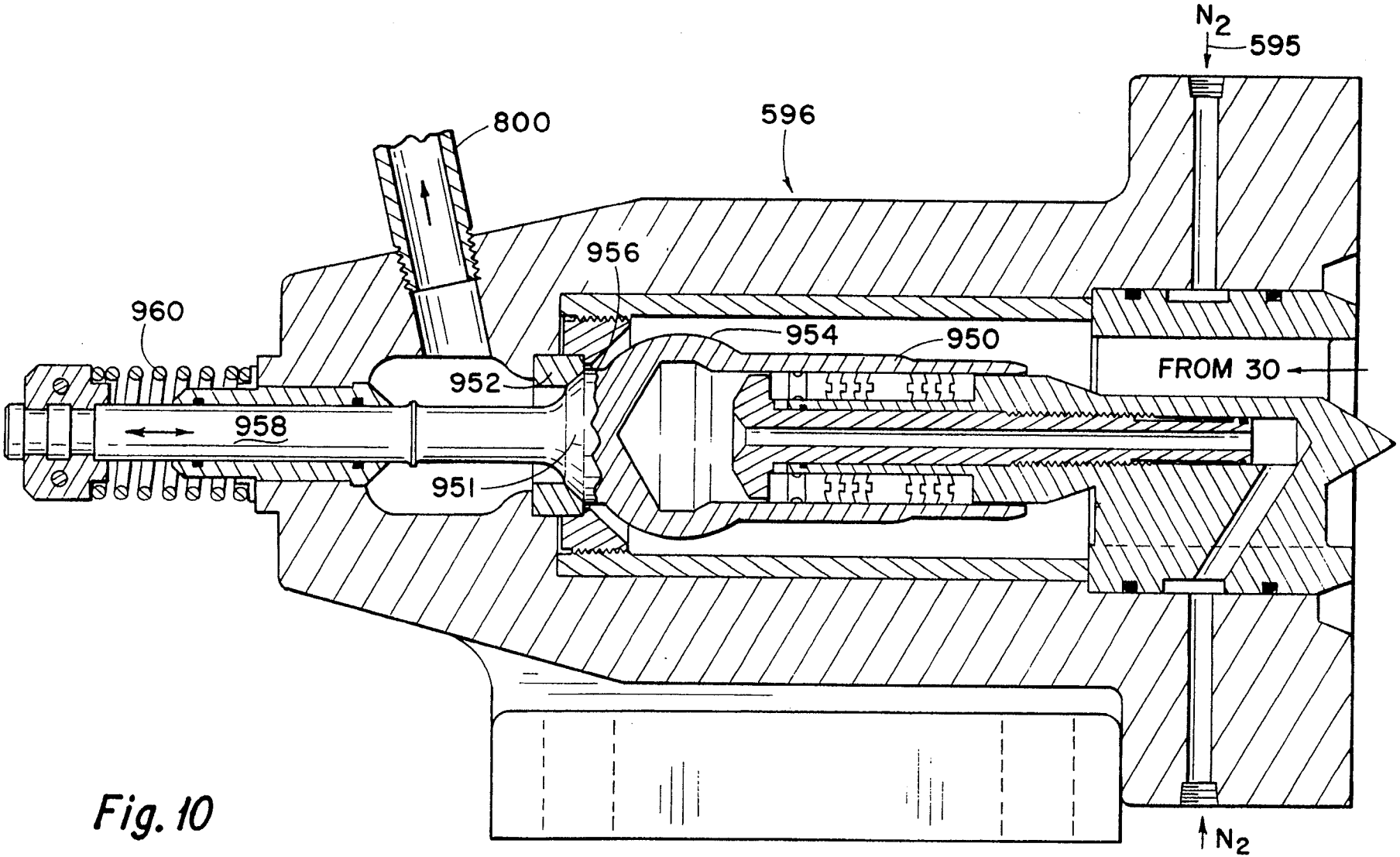
FIG. 10 is a sectional view of an improved cavitation valve used in this invention.

A modified form of cavitation valve is shown in FIG. 10. See also FIG. 39 of U.S. Pat. No. 3,981,624 for comparison. The primary improvement is to the construction of valve 950 having a seating face 951 closing against seat 952. The basic improvement is the enlarged cylindrical shoulder 956, between seating face 951 and the spherical portion 954, which when the valve is open will permit increased flow of treating liquid via conduits 800 and 802 and the resultant wave energy augmentation upon the main pressure wave created by the main pump. Disengageable and variable timed power is supplied to activate the stem 958 against the bias of spring 960.

What is claimed is:

1. Apparatus comprising:

energy generating means for carrying high frequency waves of variable characteristics as to amplitude, frequency and strength in a liquid medium which is transmitted to an object, area, or subsurface formation to be treated;

feed pump means having a suction inlet and an outlet for supplying said liquid medium under pressure to said energy generating means, a reservoir for supplying said liquid medium to said suction inlet of said feed pump;

means to maintain a substantially positive and constant head of said liquid medium to said suction inlet; and said outlet from said feed pump means is divided for delivery to at least one main pump and each said outlet to said main pump includes a check valve.

2. Apparatus of claim 1 wherein said means to maintain said head comprises a standpipe, means to maintain said standpipe filled with said liquid medium, an overflow conduit at the uppermost end of said standpipe, said overflow conduit in communication with said reservoir.

3. Apparatus of claim 2 wherein said standpipe is schedule 40 pipe, 158 mm in diameter and 6 meters in height.

4. Apparatus of claim 2 wherein said means to maintain said standpipe filled comprises an auxiliary pump, the inlet of which is in communication with said fluid reservoir, and the outlet of which is in communication with the interior of said standpipe.

5. Apparatus of claim 4 wherein the outlet of said auxiliary pump connects at an upper part of said standpipe.

6. Apparatus of claim 1 including an exteriorly controlled valve for selective communication of the interior of said fluid reservoir with the interior of said standpipe.

7. Apparatus of claim 1 wherein said feed pump is a multiple plunger or piston type.

8. Apparatus of claim 7 wherein said pump is a triplex pump.

9. Apparatus of claim 1 including a hydrodynamic buffer means between said feed pump outlet and an inlet to said energy generating means.

10. Apparatus of claim 1 wherein each said check valve is arranged to block recoil produced by said energy generating means.

11. A method of treating objects comprising the steps of:

generating, by a sonic or wave generator means, high frequency waves of variable characteristics as to amplitude, frequency, pressure, and volume into a fluid medium and transmitting said medium to said object to be treated;

providing a feed pump having a suction inlet and an outlet conduit means to supply said medium to said wave generator means;

providing a substantially constant pressure head of to said suction inlet; and maintaining, in said outlet conduit means, sufficient flow of said medium to feed said wave generating means without interruption or starvation of said medium to said wave generating means.

12. The method of claim 11 wherein said object to be treated is a subterranean oil producing formation.

13. The method of claim 11 wherein controlling said flow of medium occurs by providing a labyrinth of flow channels in said outlet conduit means.

14. The method of claim 13 wherein controlling said flow of medium occurs by providing a check valve in said outlet conduit means between said labyrinth and an inlet to said wave generating means.

15. An apparatus for creating fatigue failure of subterranean hydrocarbon fluid containing formations by creating intermittent stress/strain therein, said apparatus including an assembly of at least one powered reciprocating main pump piston and an associated cavitation valve means for creating wave energy in treating liquid of variable characteristic as to amplitude, frequency and pressure means to separately supply said treating fluid to said main pump piston and said cavitation valve means, and gaseous dampening means for each said cavitation valve, the improvement comprising:

a fluid reservoir for constant uninterrupted supplying said treating fluid to a suction inlet of said feed pump;

means to maintain a substantially positive and constant pressure head to said suction inlet;

an outlet from said feed pump for delivery to each of said pumps, said outlet including a check valve for each of said pumps;

labyrinth means for each assembly, which is incorporated in said outlet between said feed pump and said check valve for dampening reverberating unwanted wave energy between said pump piston and between said pump piston and said feed pump; and means to activate said cavitation valve at any desired and chosen time.

16. Apparatus of claim 15 the further improvement in separately supplying, to each assembly, pressurized dampening gas to each said cavitation valve.

17. Apparatus comprising:

energy generating means for carrying high frequency waves of variable characteristics as to amplitude, frequency and strength in a liquid medium which is transmitted to an object, area, or subsurface formation to be treated;

feed pump means having a suction inlet and an outlet for supplying said liquid medium under pressure to said energy generating means, a reservoir for supplying said liquid medium to said suction inlet of said feed pump;

means to maintain a substantially positive and constant head of said liquid medium to said suction inlet; and said outlet from said feed pump means is divided for delivery to an inlet to at least one main pump and each said inlet to each said main pump includes a check valve.

18. Apparatus of claim 17 wherein said means to maintain said head comprises a standpipe, means to maintain said standpipe filled with said liquid medium, an overflow conduit at the uppermost end of said standpipe, said overflow conduit in communication with said reservoir.

19. Apparatus of claim 18 wherein said standpipe is schedule 40 pipe, 152 mm in diameter and 6 meters in height.

20. Apparatus of claim 18 wherein said means to maintain said standpipe filled comprises an auxiliary pump, the inlet of which is in communication with said fluid reservoir, and the outlet of which is in communication with the interior of said standpipe.

21. Apparatus of claim 20 wherein the outlet of said auxiliary pump connects at an upper part of said standpipe.

22. Apparatus of claim 17 including an exteriorly controlled valve for selective communication of the interior of said fluid reservoir with the interior of said standpipe.

23. Apparatus of claim 17 wherein said feed pump is a positive pressure pump.

24. Apparatus of claim 23 wherein said feed pump is a multiple plunger or piston type.

25. Apparatus of claim 24 wherein said pump is a triplex pump.

26. Apparatus of claim 17 including a hydrodynamic buffer means between said feed pump outlet and an inlet to said energy generating means.

27. Apparatus of claim 17 wherein each said check valve is arranged to block recoil produced by said energy generating means.

28. In apparatus for creating fatigue failure of subterranean hydrocarbon fluid containing formations by creating intermittent virtual work via stress/strain therein, said apparatus including an assembly of at least one powered reciprocating main pump piston and an associated cavitation valve means for creating in a treating fluid wave energy of variable characteristic as to amplitude, frequency and pressure, means to separately supply said treating fluid to an inlet to said main pump piston and to said cavitation valve means, and gaseous dampening means for each said cavitation valve, the improvement comprising a fluid reservoir for a supplying and maintaining a hydrostatic pressure head of said treating fluid to a suction inlet of said feed pump;

means to maintain a substantially positive and constant pressure head to said suction inlet;

an outlet from said feed pump for delivery to each of inlet said pumps, said outlet including a check valve for each of said pumps;

buffer means for each assembly, which is incorporated in said outlet between said feed pump and each said check valve for dampening reverberating unwanted wave energy between said pump pistons and said feed pump; and means to activate said cavitation valve at any desired and chosen time to enhance or create resonance within said wave energy.

29. Apparatus of claim 28 the further improvement in separately providing to each assembly, pressurized gas to dampen each said cavitation valve.

30. Apparatus of claim 29 wherein said gas is nitrogen or other inert gas.

31. Apparatus of claim 28 wherein said buffer means comprises a plurality of unequal length conduits interconnected by variably spaced transverse inlet/outlet conduits along the flow path of said treating fluid to said main pump piston.

32. Apparatus of claim 28 wherein said buffer means comprises a plurality of closed end conduits each with side entrance and outlet connections to form, in series, chambers between said closed ends and said inlet and outlet connections of substantially different lengths.

33. Apparatus of claim 32 wherein each of said closed end conduits creates at least three of said chambers.

34. Apparatus of claim 28 wherein said fluid is a liquid medium with means to maintain a hydrostatic pressure head is by a standpipe, means to maintain said standpipe filled with said liquid medium, an overflow conduit at the uppermost end of said standpipe, said overflow conduit in communication with said fluid reservoir.

35. Apparatus of claim 34 wherein said standpipe is schedule 40 pipe, 152 mm in diameter and 6 meters in height.

36. Apparatus of claim 34 wherein said means to maintain said standpipe filled comprises an auxiliary pump, the inlet of which is in communication with said fluid reservoir, and the outlet of which is in communication with the interior of said standpipe.

37. Apparatus of claim 36 wherein the outlet of said auxiliary pump connects at an upper part of said standpipe.

38. Apparatus of claim 28 including an exteriorly controlled valve for selective communication of the interior of said fluid reservoir with the interior of said standpipe.

39. Apparatus of claim 28 wherein said feed pump is a positive displacement pump.

40. Apparatus of claim 39 wherein said pump is a triplex pump.

41. A method of treating objects comprising the steps of:

generating, by a sonic or wave generator means, high frequency waves of variable characteristics as to amplitude, frequency, pressure, and volume into a fluid medium and transmitting said medium to said object to be treated;

providing a feed pump having a suction inlet and an outlet conduit means to supply said medium to said wave generator means;

providing a hydrostatic pressure head of said fluid medium to said suction inlet; and maintaining, in said outlet conduit means, sufficient flow of said fluid medium at substantially constant pressure to an inlet feed to said wave generating means without interruption or starvation of said fluid medium to said wave generating means.

42. The method of claim 41 wherein said object to be treated is a subterranean oil producing formation.

43. The method of claim 41 wherein controlling said flow of medium occurs by providing a plurality of buffer conduits between said outlet conduit means and said inlet feed to said wave generating means.

44. The method of claim 43 wherein said buffer includes at least three conduits.

45. The method of claim 44 wherein said three conduits are in parallel connected by transverse conduits.

46. The method of claim 41 wherein controlling said flow of medium occurs by providing a check valve in said outlet conduit means between said buffer and an inlet to said wave generating means.

47. A method of treating objects comprising the steps of:

generating, by a sonic or wave generator means, high frequency waves of variable characteristics as to amplitude, frequency, pressure, and volume into a fluid medium and transmitting said fluid medium to said object to be treated;

providing a feed pump having a suction inlet and an outlet conduit means to supply fluid medium to said wave generator means;

providing a substantially constant hydrostatic pressure head of fluid to said suction inlet;

controlling, in said outlet conduit means, the flow of fluid medium to said wave generating means by passing said flow of fluid medium through first a wave absorbing a buffer of parallel conduits interconnected by transverse and variably spaced inlet/outlet conduits, thence through a check valve before entering said wave generating means.

48. The method of claim 47 wherein said object to be treated is a subterranean oil producing formation.

49. The method of claim 47 including the steps of:

determining the natural frequency of a subterranean formation;

creating periodic loads in said fluid medium of a frequency substantially equal to said natural frequency whereby there is a build-up of amplitude of said frequency until rupture or fracture of said formation.

50. A method of fatigue fracturing a subterranean fluid formation comprising the steps of:

determining the natural frequency of said subterranean formation;

applying pressurized stress via a treating fluid medium against and into said formation to cause said formation to be under displaced strain energy; and intermittently by command, for timed periods, creating periodic loads in said fluid medium of a frequency substantially equally to said natural frequency whereby there is a build-up of amplitude of said frequency until rupture or fracture of said formation.

51. The method of claim 50 wherein said fluid medium is a liquid.

52. The method of claim 50 wherein said fluid medium is a compressible medium.

53. A method of fatigue fracturing a subterranean fluid formation comprising the steps of:

1) applying pressurized stress via a treating fluid medium against and into said formation to cause said formation to be under displaced strain energy and 2) intermittently by command, for timed periods, relieving or reversing said pressurized stress until said formation is fractured, 3) said pressurized stress being created by:

a fluid pressure pump means supplying, from a feed pump, a constant volume and pressure of a treating fluid to an inlet, the outlet of which communicates with said formation; and preventing reverbratory energy from said fluid pressure pump to said feed pump.

54. The method of claim 53 wherein said reverbratory energy is hydrodynamically absorbed.

55. The method of claim 53 wherein preventing of reverbratory energy occurs by reducing said energy via a labyrinth of conduits comprised of a series of conduits of different lengths being interconnected by right angle outlets and inlets.

56. A method of creating fatigue fracture of a subterranean formation comprising the steps of:

determining the natural frequency of said subterranean formation;

creating virtual work of said formation by periodically applying pressurized stress of a frequency substantially equal to said natural frequency via a treating fluid against and into interstices of said formation to thereby cause said formation to be under periodic displaced strain and thereby creating in said formation potential energy and thence periodically relieving said strain until said formation is fractured.

57. The method of claim 56 wherein said treating fluid is a liquid.

58. The method of claim 57 wherein said liquid contains gas.

59. The method of claim 58 including the step of applying heat to said liquid.

* * * * *